US006857233B2

(12) United States Patent
Farag

(10) Patent No.: US 6,857,233 B2
(45) Date of Patent: Feb. 22, 2005

(54) FIRE RESISTANT RATED FENESTRATION, INCLUDING CURTAIN WALL SYSTEMS, FOR MULTIPLE STORY BUILDINGS

(76) Inventor: F. Aziz Farag, 43 N. Juliet St., Iselin, NJ (US) 08830-2026

( * ) Notice: Subject to any disclaimer, the term of this patent is extended or adjusted under 35 U.S.C. 154(b) by 64 days.

(21) Appl. No.: 10/102,892

(22) Filed: Mar. 22, 2002

(65) Prior Publication Data

US 2002/0148178 A1 Oct. 17, 2002

Related U.S. Application Data

(60) Provisional application No. 60/277,633, filed on Mar. 22, 2001, and provisional application No. 60/304,411, filed on Jul. 12, 2001.

(51) Int. Cl.[7] ..... E04B 2/00

(52) U.S. Cl. ..... 52/235; 52/404.1; 52/766; 52/775; 52/780

(58) Field of Search ..... 52/235, 404.1, 52/762, 764, 766, 775, 780, 781

(56) References Cited

U.S. PATENT DOCUMENTS 3,380,210 A * 4/1968 Neal et al. ..... 52/235
3,782,064 A * 1/1974 Hubbard et al. ..... 52/97
4,021,987 A * 5/1977 Schnebel et al. ..... 52/764
4,449,341 A * 5/1984 Taglianetti et al. ..... 52/235
4,557,089 A * 12/1985 Breithaupt ..... 52/235
5,309,689 A * 5/1994 Croissant ..... 52/235
5,355,645 A 10/1994 Farag
5,381,637 A 1/1995 Farag
5,481,839 A * 1/1996 Lang et al. ..... 52/235
5,579,616 A 12/1996 Farag
5,746,032 A * 5/1998 Koike et al. ..... 52/204.1
5,765,332 A * 6/1998 Landin et al. ..... 52/396.01
5,839,236 A * 11/1998 Frey ..... 52/235
6,141,923 A * 11/2000 Habicht et al. ..... 52/235
6,421,968 B2 * 7/2002 Degelsegger ..... 52/204.62

* cited by examiner

*Primary Examiner*—Brian E. Glessner
(74) *Attorney, Agent, or Firm*—Oliff & Berridge, PLC

(57) ABSTRACT

Apparatus and systems for a fire resistant rated fenestration including curtain wall systems for multiple story buildings capable of withstanding a seismic load. Fire resistant panels are mounted in a fire resistant mullion where the mullion may be one element, or may have an inner structural shell and an outer shell. A barrier of fire resistant material is disposed between the inner and outer shells. A sealer compound or a fire resistant compressible filler seals the space between the mullion and the fire resistant panels. The inner structural shell member is connected to an elastic panel fastener that is connected at its opposite end to fire resistant panels. The fastener allows the fire resistant panels to move in response to a seismic load without damage to the mullion or panels.

14 Claims, 14 Drawing Sheets

FIRE RESISTANT RATED FENESTRATION, INCLUDING CURTAIN WALL SYSTEMS, FOR MULTIPLE STORY BUILDINGS

BACKGROUND OF THE INVENTION

This application claims priority from U.S. Provisional Application No. 60/277,633 filed Mar. 22, 2001, and Provisional Application No. 60/304,411 filed Jul. 12, 2001, the disclosure of which are herein incorporated by reference.

1. Field of Invention

This invention relates to fire resistant fenestration for use in buildings and other structures and also to fire resistant fenestration capable of withstanding seismic loadings.

2. Description of Related Art

Fenestration includes windows, multiple window strips, curtain walls, store fronts, entrances, sloped glazing and the like. Fenestration comprises a frame of at least one piece, which holds at least one panel, or a supporting grid frame having multiple vertical and horizontal members to hold multiple panels. The frames and panels can have an endless variety of shapes, forms and sizes. Panels may be made of glass, metal, marble, granite, composite or the like. Currently, some types of glass and other facing panels can be provided in a fire resistant rated panel. Frames for use in curtain walls are currently made of metal, plastic or wood, but all the currently available frames do not have any fire resistance. In particular, aluminum frames for use in curtain walls are currently not provided with fire resistance.

Fire in a multiple story building can be devastating. Fenestration and in particular curtain walls do not resist or contain fire. Rather, the fenestration is usually destroyed by fire, and flames can spread from one floor to an adjacent upper floor from the outside of the building through the destroyed exterior skin of the curtain wall or other fenestration. Therefore, the fire on the floor where the fire originated usually destroys the fenestration directly above that floor and spreads to the adjacent upper floor, and so on throughout the building.

New advances in resin composite materials technology have resulted in a new light-weight, high strength material with unique fire resistant properties. Materials such as Moldite™, manufactured by Moldite Technologies of Novi, Michigan are one such product.

U.S. Pat. Nos. 5,381,637; 5,355,654; and 5,579,616 describe curtain wall systems and panel securing systems for creating the exterior surface of a multiple story building. The disclosures of the above-identified patents are herein incorporated by reference.

SUMMARY OF THE INVENTION

This invention relates to using resin composite materials in creating fire resistant fenestration. A fire resistant fenestration assembly is created by combining the fire resistant resin composite material with fire resistant rated glass or other facing materials. The combined fire resistant fenestration assembly of this invention has the ability to pass fire resistance rating duration tests. The fenestration frame members of this invention may be made in different thickness and shapes to meet different fire resistant duration ratings criteria.

This invention comprises various fire resistant rated fenestration and curtain wall systems, where the fire resistant rating may be determined according to a variety of formal test procedures. Testing is usually performed on completed assemblies. The thickness of the barriers and panels may be adjusted to provide the required exposure time durations for different fire resistance ratings. A mullion, as described herein, is a strip or portion of frame dividing a panel or glass. In various exemplary embodiments, fire resistant barriers may form a full mullion shell, and have the proper amount of coverage for the edge of a glass or panel. In other exemplary embodiments, a barrier may also be used as a fill between two shells, where the outer exposed shell can be affected by fire and may be damaged. Still in other exemplary embodiments, the inner structural shell may also have fire barrier material around it. The two shells may be extruded as one extrusion and after being filled with barrier material they may be separated and thermally broken into two separate shells.

The fire rated fenestration and curtain wall designs of this invention may also be provided with special seismic safe features for seismic zones. In these embodiments, the panels and glass are attached by means that allow them to remain in place when the building sways sideways and also engages in a twisting movement. When this occurs, the perpendicular angularity of the frames may be deformed while the panels are not deformed. In these exemplary embodiments, the centerline of the mullion may travel past the center of the joint between the panels.

In various exemplary embodiments of the present invention, the mullions may be exposed. In other exemplary embodiments, monolithic stopless facing panel curtain walls where mullion members are not exposed from the exterior side may also be used. Facing panels may be of glass or any other material of uniform or composite construction, of one or multiple layers.

BRIEF DESCRIPTION OF THE DRAWINGS

Various exemplary embodiments of the invention will be described with reference to the accompanied drawings, in which like elements are labeled with like numbers, and in which:

FIG. 28 is a horizontal cross sectional detail view of mullion alternative of stopless curtain wall, partitions, and sloped roof or glazing;

FIGS. 31 and 32 are horizontal cross sectional detail views of mullion alternatives of stopless curtain wall, partitions, and sloped roof or glazing;

DETAILED DESCRIPTION OF PREFERRED EMBODIMENTS

Figure 1:
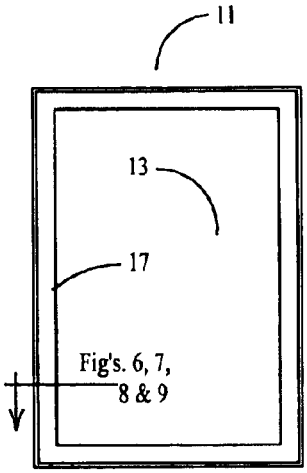
FIG. 1 is a front view of a window.

FIG. 1 through FIG. 36 illustrate views and details of windows, strip windows, store fronts, entrances, including fixed or operable windows, single doors or double door entrances, curtain walls, partitions and sloped roof or glazing that are referred to in this invention for briefness as "Fenestration". The exemplary embodiments of fenestration in this invention may be used as a fire barrier with the fire resistance ratings presented herein. The exemplary embodiments of fenestration of this invention possess the added function of containing fire and smoke (if and when it occurs) to the floor, room, or to the side of the fenestration where the fire originated, and to keep it on that side until all personnel at both sides of the barrier may be safely evacuated within a designated time.

It should be noted that the various embodiments of fenestration of this invention may have any possible configuration and be of single or multiple panels in any shape. The single or multiple panels may have intermediate dividing single or multiple mullions in any position, in a modular or non-modular arrangement. They may also have the face plane of the facing panels at the same plane or in multiple face planes, in a regular or irregular fashion in any arrangement, with an endless variety of shape, form, size, or combination.

The fire barrier may be made of one monolithic material, composed of fire barrier, fire retardant, heat insulation, non-combustible and like materials, and it may be made of one or multiple materials in a mixture in substance or as layers. Assemblies, sections, and components made of one monolithic fire barrier material can be redesigned and reformed in layers, or with a parameter shell made of multiple materials, or a single material for a casting shell. These assemblies sections and components may also be made of a double shell, with an inner core structural shell and an outer exposed shell with a space in between the two shells as the casting form for the housing of the fire barrier material. Assemblies, sections, and components shown with a single or multiple shell, part, or portion made of different material, can be redesigned and reformed in one monolithic sections of fire barrier.

The material illustrated and used herein as a fire barrier material is preferably made of Moldite™, by Moldite Technologies, which is based on a new proprietary high-tech composite material. Other materials like mineral fiber or like kinds of fire proofing, fire retarding or non-combustible materials approved by codes for such use may be used.

Fire barrier mullions, mullion walls, barrier filled cavities between mullion shells, and facing panels may be furnished in different thicknesses for each particular element. Material of the assembly may be suited such that the whole assembly may withstand a fire without structural failure. The assembly may also withstand a fire for a time duration required for each particular time rating test, and in accordance with a particular fire rating test protocol and procedures.

The components of fire resistant rated fenestration presented in various exemplary embodiments of this invention can be used as a whole, or in part, and in combination with non fire rated mullions, frames or panels or the like for decorative and other architectural non fire rating uses. The frame members and mullions presented herein may be used solely for structural functions to the exceptional high stiffness-to-weight ratio of the Moldite material. Facing panels may be of any type, thickness, or material of uniform or composite construction, such that the whole assembly of the panel may have a designated fire resistance rating. This may be accomplished while having the exposed layer or finish in decorative, natural or man made material, in any type of finish. Fire rated glass panels are available in different thickness and construction for each designated rating. Panels are shown engaging the mullions in a central location for a clearer explanation of the concept of this invention, but the presented embodiments may be designed such that panels can be in a non-central location in relation to mullions.

If the components of a fenestration do not have the same rating, it is expected that completed, assembled and tested fenestration will have an overall rating equivalent to that of the least rating of its individual components. Barrier cover is defined as the depth of engagement of the facing panel inside the mullion wall cavity, and it is also considered the size of barrier coverage for the edge of the panel. Glazing and installation methods of the different panels and the materials used are to be closely coordinated with panel manufacturers in accordance with their recommendations and future tests.

The shape of the mullions and components shown in cross sectional detail views may be in the form of decorative moldings, fillets, ornament-like outlines and corners without loosing the rated barrier characteristics. The mullions of the exemplary embodiments of this invention are illustrated in simple outlines for briefness. The size of the mullions and components shown as solid pieces may be formed as larger pieces of the same configuration but with cavities and multiple walls. It is expected that testing will show that the summation of these multiple wall thicknesses may be equal to the relative solid thickness, as known in the architectural trade as the "equivalent solid thickness", which is used in the rating of cement block units.

The finish of the surface of the mullion and all the components shown without a parameter shell to contain the fire barrier material presented herein may be cast, molded, carved out of blocks, machine shaped, extruded, or pull-truded. The components may be left with a natural mill finish, be finished all around, or only at the exposed surfaces. These components may also be finished with cold applied finish coats like special primer and paint, vinyl, plastic laminate, or cladded with metal sheets or the like. Hot finish applications may include baked enamel, or spray with molten metal or ceramic frit or the like.

FIG. 1 is a front view of window 11. The window 11 consists of one fire resistant rated fixed panel portion 13. The panel portion 13 of this embodiment may be a glass panel. The window 11 has a frame 17 of at least one piece. The frame 17 may be made in one piece or multiple pieces. The panel 13 is installed in window frame 17.

Figure 2:
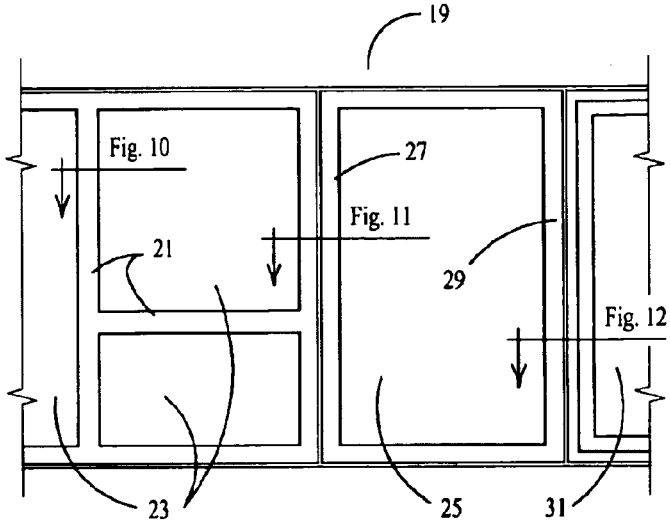
FIG. 2 is a front view of a partial strip window, store front, and an entrance with multiple windows including operable windows.

FIG. 2 illustrates a partial strip window 19, also known as a ribbon window. The partial strip window 19 could be utilized as a store front, or entrance. Portion 19 is divided vertically and horizontally with intermediate mullions 21 to have multiple panels 23. The multiple panels 23 may be in any arrangement, and either be fixed or operable sash. They may also be uniform or in any combination. Strip window 19 consists of multiple window units installed against each other. Intermediate mullion 27 between windows 23 and window 25 is a two-piece split mullion, where the two frames of the adjacent windows meet. Intermediate mullion 29 is between window 25 and window 31. In this embodiment window 31 is an operable sash type window.

Figure 3:
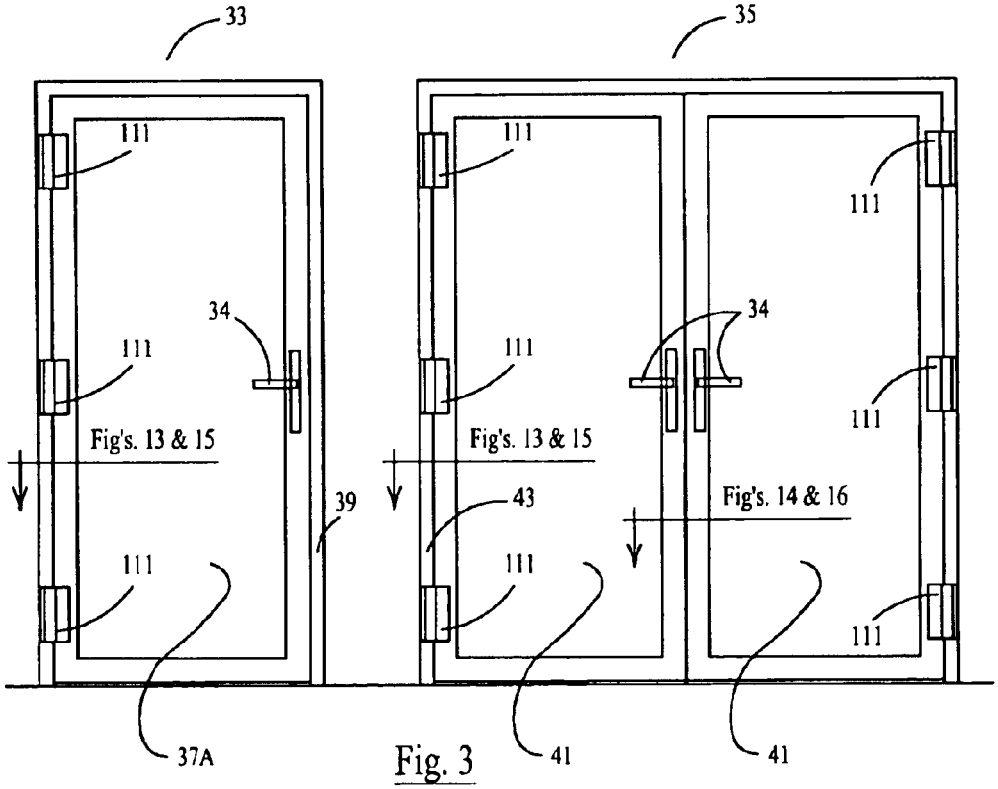
FIG. 3 is a front view of single and double door entrances.

FIG. 3 illustrates a single doorway 33 and a double doorway 35. Single doorway 33 consists of one door 37A and frame 39. Door 35 consists of two doors 41 and frame 43. The doors 37A and 41 are rotatably secured to the frames 39 and 43 respectively by hinges 111 and may be opened via handles 34.

Figure 4:
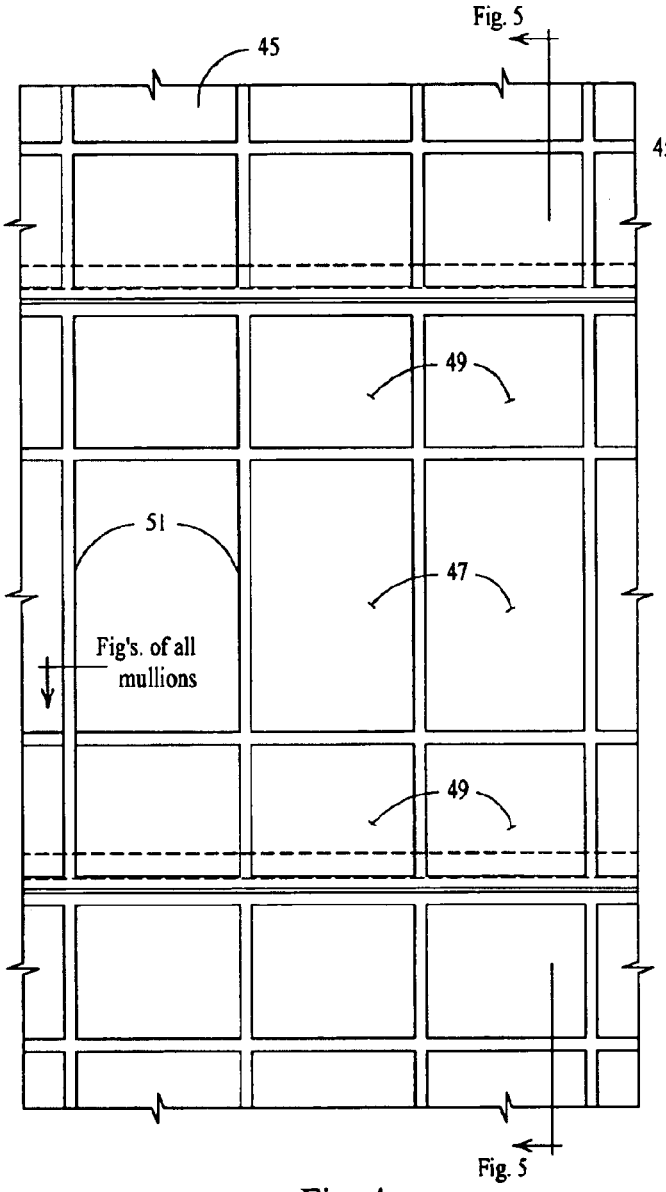
FIG. 4 is a front view of a partial curtain wall facade.
Figure 10:
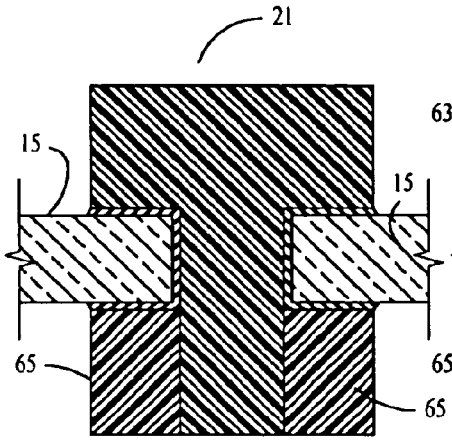
FIGS. 10 through FIG. 12 are horizontal cross sectional detail views of different intermediate mullion alternatives of the partial strip window, store front, and entrance, with multiple windows and operable windows as shown in FIG. 2.
Figure 11:
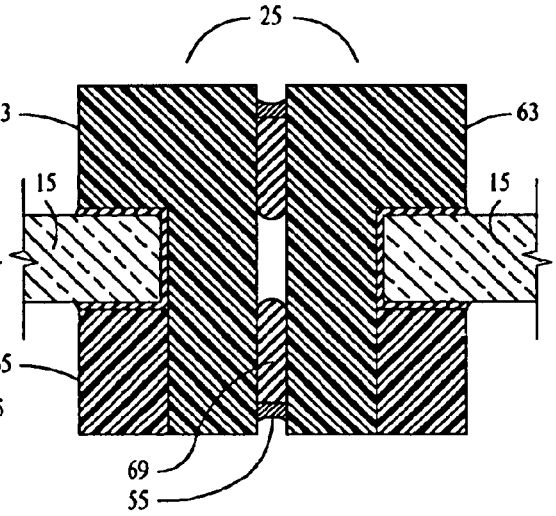
Figure 17:
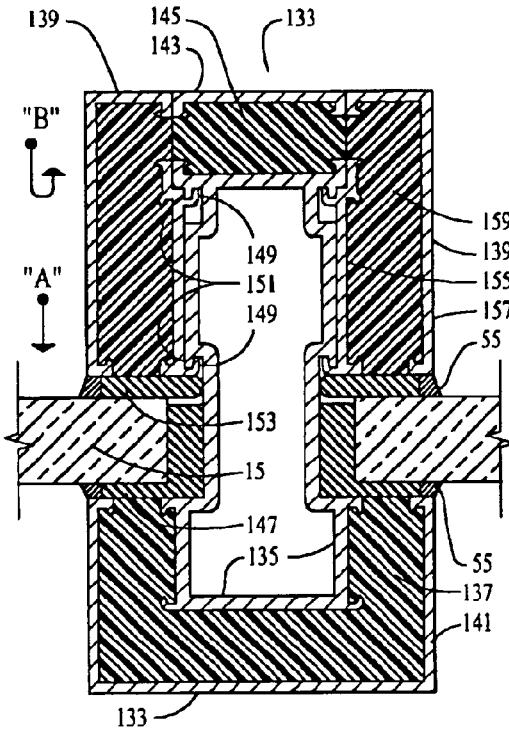
FIGS. 17, 18, 22, 26, 27, 28, 31, and 32 are horizontal cross sectional detail views of different alternative mullions of a curtain wall as shown in FIG. 4.

FIG. 4 illustrates a partial curtain wall 45 of a building facade consisting of vision panels 47, and non-vision panels 49 at the spandrel area where beams, columns, slabs, ventilation ducts (not shown) above a suspended ceiling and convector enclosures (not shown) at floor level may be located. Mullions 51 are supporting the facing panels and transmitting the loads to the building structure. Mullions 51 may be intermediate mullions as shown in FIGS. 10, 11 and 17. The mullions 51 may be used as components in different combinations to make up various designs. The mullions 51 illustrated in FIG. 4 may be the two piece split mullion shown in FIGS. 12, 18, 22, 26, 27, 28, 31, 32 and 33, or of a design with a different combination of components from these mullions.

Figure 5:
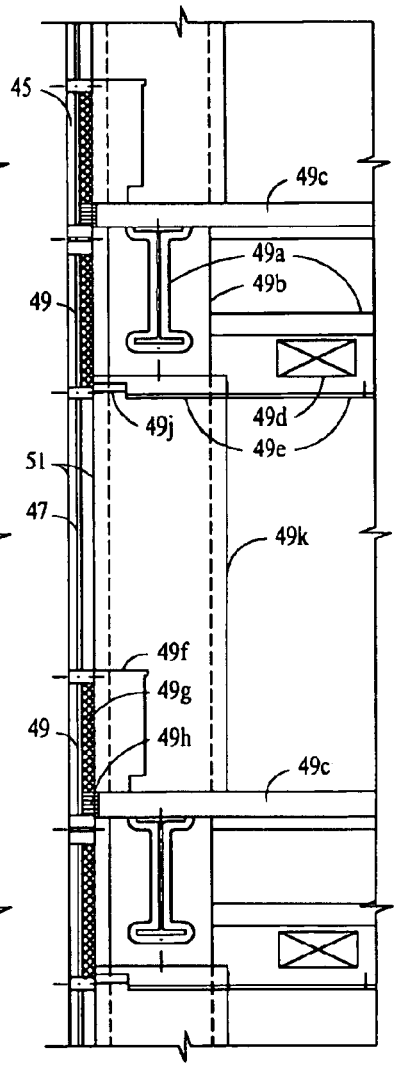
FIG. 5 is a vertical cross sectional view of a curtain wall facade as shown in FIG. 4.

FIG. 5 is a vertical cross section to the curtain wall partial building facade of FIG. 4. It illustrates the self supported curtain wall 45 as the exterior wall enclosing the floor space, and the mullions 51 are shown with a vision panel 47 at the floor area where the exposed portion of a column at floor area has a decorative cover 49*k*. Non-vision panels 49 preferably are located at the spandrel area for hiding the sight of beams 49*a* and column 49*b* which are shown with a coat of fire proofing spray. Concrete slab 49*c* and ventilation ducts 49*b* are above the suspended ceiling 49*e*. Suspended ceiling 49*e* consists of acoustic tiles in a grid, the light fixtures, and the air diffusers of the heating, ventilation and air conditioning systems. Convector enclosure 49*f* adjacent to the curtain wall is preferably used for parameter heating. Thermal insulation panels 49*g* are integrally installed as backing behind non-vision panels in the curtain wall for energy conservation. Fire Stop 49*h* is to block the spread of fire between floors, and has the same fire resistance rating of the floor assembly. Venetian blinds or curtains may be installed in Curtain Pocket 49*j*.

Figure 6:
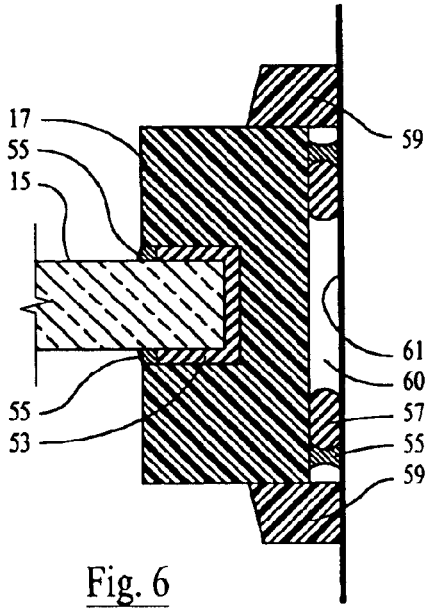
FIGS. 6 through FIG. 9 illustrate horizontal cross sectional detail view alternatives for window frame mullions as shown in FIG. 1.

FIG. 6 illustrates a cross section of one piece frame mullion 17 of window 11 shown in FIG. 1. Mullion 17 is made of a fire barrier material and is of a wall thickness suited to the designated rating of the window, and to the rating of installed panel. Glass panel 15 is factory installed while the window frame is assembled. The mullion 17 is formed as a channel shape for creating a cavity to install the glass panel 15 having a deep engagement for creating a specific cover distance to the edge of the glass panel 15. A compressible lining pad 53 is used between the mullion 17 and glass panel 15. The lining pad 53 may be made of mineral fiber or other fire resistant materials.

A weather seal 55 is used to seal glass panel 15 to the mullion 17 and to lining pad 53. The weather seal 55 may be made of silicone, mineral compound, or other such materials with a high resistance to heat. A wall joint 60 between mullion 17 and an adjacent wall 61 preferably have the same fire resistance rating of the glass panel 15. A compressible filler 57 and a weather seal 55 function to weather seal each side of the wall joint 60. The weather seal 55 between glass panel 13 and mullion 17 and wall joint 60 also functions as a smoke barrier between the two sides of fenestration, and a rated barrier strip 59 provides the needed fire rated barrier to wall joint 60, and preferably has enough thickness to withstand fire and heat for a required duration.

Figure 7:
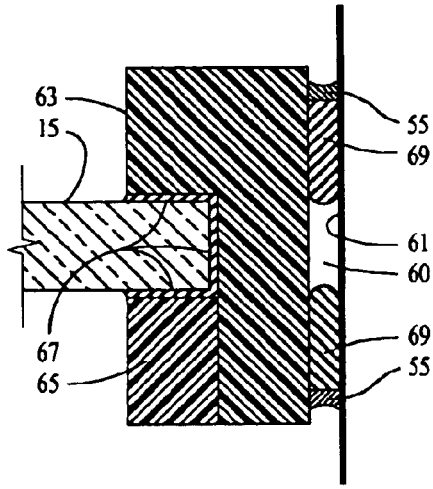

FIG. 7 is an alternative design to the design shown in FIG. 6. Glass panel 15 can be either factory installed or field installed after a mullion 63 is first put into place. A glazing strip 65 is fastened to mullion 63 and retains the glass panel 15. A lining pad 67 is used to install the glass panel and is thinner than the pad 53 shown in FIG. 6. It may be weather sealed to the mullion and to the glass panel 15 by applying a thin coat of weather seal 55 to all adjacent surfaces and to exposed ends during the installation of the glass panel. The lining pad 67 may also be a pre-formed compressible glazing tape made of mineral fibers or other non combustible fabric. It may be encased between thin coats of silicone rubber material or the like and may be used to as a sealer, while enhancing the fire barrier function of the glass panel 15, mullion 63 and the glazing strip 65. The lining pad 67 could also be in the form of a very thin coat of sealer compound. A compressible filler 69 is wedged at each side of the joint 60 between the mullion 63 and the wall 61. In this embodiment it may replace the rated barrier strip 59, as shown in FIG. 6. The compressible filler 69 is similar to the lining pad 67 and has enough depth to act as a fire barrier between the mullion 63 and the wall 61, where the joint 60 also get capped with smoke and weather seal 55.

Figure 8:
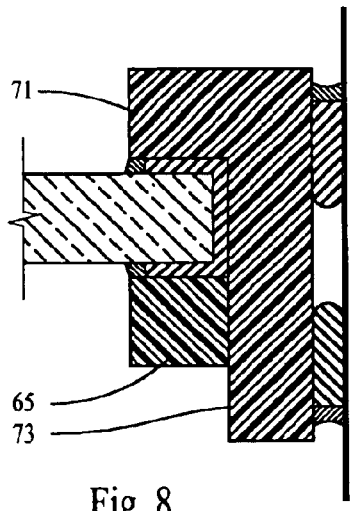
Figure 9:
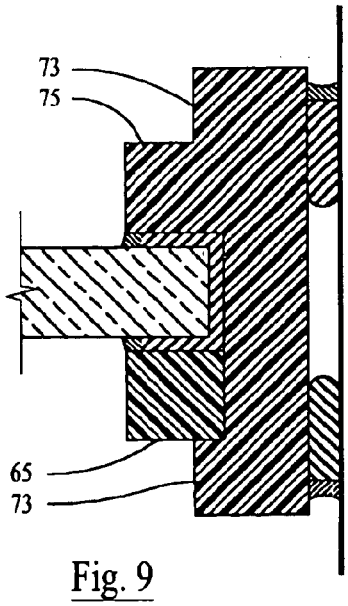

FIG. 8 illustrates a dissymmetrical mullion 71, which is an alternative to mullions 17 and 63. The mullion 71 has an extended portion 73 that adds more depth to the bulk of the mullion and provides additional structural stiffness if and where it is needed. FIG. 9 illustrates a symmetrical mullion 75 having extended portions 73 at the two sides. The symmetrical mullion 75 provides greater structural stiffness. The glazing strip 65 of this embodiment is installed in a corresponding cavity in a wall of mullion 75. FIG. 10 illustrates an intermediate mullion 21, and it is similar to the previously shown mullions 63. It allows for the installation of glass panels 15 and glazing strips 65 opposite sides of intermediate mullion. FIG. 11 illustrates an intermediate mullion 25 having two back-to-back mullions 63, as shown in FIG. 7. The intermediate mullions of this embodiment use the same seal method at the joint between the two mullions as used in joint 60 between mullion 63 and wall 61.

Figure 12:
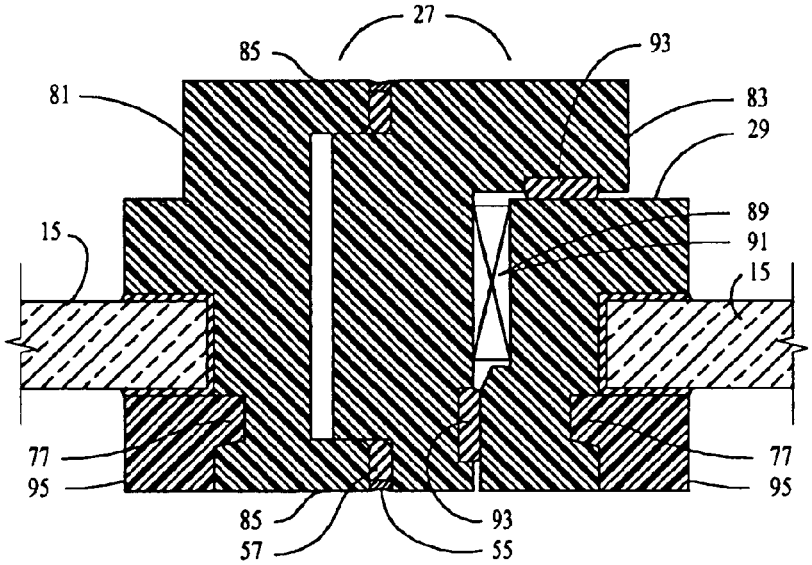

FIG. 12 illustrates intermediate mullion 27 composed of two interlocking split mullion halves with female left half 81 and male right half 83. The joint between the two halves has fire barrier cover protruding portions 85 at the two ends of female mullion half 81. Protruding portions 85 engage two corresponding cavities formed in male mullion half 83. Protrusions 85 retain and interlock the male mullion 83 and the area where compressible filler 57 and smoke/weather seal 55 are applied to the exposed joint in-between the two halves. Mullion half 83 has an "L" shape to receive an operable window sash 29, where an Inner cavity 89 is formed in-between the two. The inner cavity 89 is provided to house an operable hinge 91 which is shown with diagonal lines. The inner cavity 89 is located in a central location such that a barrier cover is provided all around the hinge 91.

The hinge 91 is preferably composed of swiveling multiple steel bars, and it may expand outward to allow the sash 29 to swing in a balanced state and move around a horizontal axis. The horizontal axis is preferably at the top if the sash 29 swings outward, and at the bottom if the sash 29 swings inward. Other centrally located expanding concealed hinges, such as a "Soss" hinge, may also be used as alternative hinges. These types of hinges perform like a pivoted hinge while being invisible, and are usually used in special hardwood doors. It is installed inside the assembly with a barrier cover, and provides a horizontally swinging sash around a vertical axis at either side. Other types of necessary operational hardware may be provided or closely developed by hardware manufacturers. Male mullion 83 may be deep enough to back-up two sashes 29 side-by-side for horizontally sliding windows with two adjacent rails (not shown), or for vertically operable single or double hung windows (not shown), barrier cover around the cavities which house the needed hardware may be provided in similar designs as presented herein.

A pile strip 93 is attached to and engages a corresponding cavity in mullion 83 located at each end of the joint between mullion 83 and sash 29. Pile strip 93 can be made of mineral fibers or the like, and it should have enough width to complement the fire barrier around the hinge and between the two sides of the window. Glazing strip 95 is designed for the possibility of field glazing to install and retain glass panel 15. Glazing strip 95 has a protruding portion 77 which is retained in a corresponding cavity in mullion 81 and sash 29.

Figure 13:
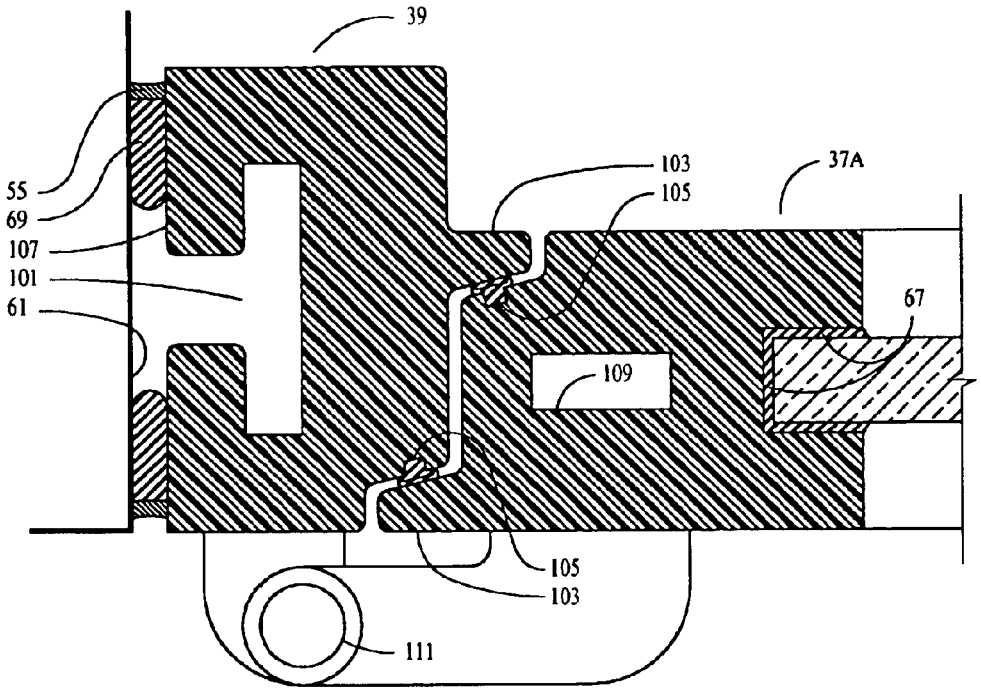
FIG. 13 is a horizontal cross sectional detail view of a door frame as shown in FIG. 3.

FIG. 13 illustrates a cross section of a hinged portion of a single door and frame unit 33, and double door and frame unit 35 shown in FIG. 3. Vertical side jamb 39, and the adjacent vertical door stile 37A apply for single door and double doors. Cavity 101 inside jamb 39 is centrally located between the walls of the jamb 39, and it is the rated housing for hinge fasteners or other required hardware. Extended portions 107 hold the wedged compressible filler 69 against the wall 61. The wall 61 can be replaced by another back-to-back door jamb or any other store front or entrance mullion for any type of entrance facade or fenestration. The filler 69 is capped with smoke/weather seal 55. The jamb 39 is formed to correspond with the profile of the edge of a door stile 37A.

Both the jamb 39 and door stile 37A have a similar tapered protrusion 103 which engage the corresponding tapered cavities in both. Gaskets 105 are attached to and engage cavities in each tapered cavity provided for protrusions 103 such that the gaskets 105 work as resting pads to the protrusions 103. Cavity 109 is centrally located inside door stile 37A and with the surrounding walls as a designated fire barrier cover. The cavity 109 is a rated housing for fasteners of hinges and other hardware elements. Doors are usually glazed in the factory while being assembled and a glazing removable strip similar to glazing strip 95 may be provided for a field glazing detail. The lining pad 67 may also be of pre-formed compressible glazing tape. Hinge 111 may be a single, continuous, or multiple hinge and may also be fire rated. Single or multiple expanding Soss hinges may also be installed in a central location with the needed barrier cover. A jamb and door stile at the opposite side of the door will be similar to FIG. 13 but reversed and chamber 109 at the door stile 37A may partially house the lock and other applicable hardware.

Figure 14:
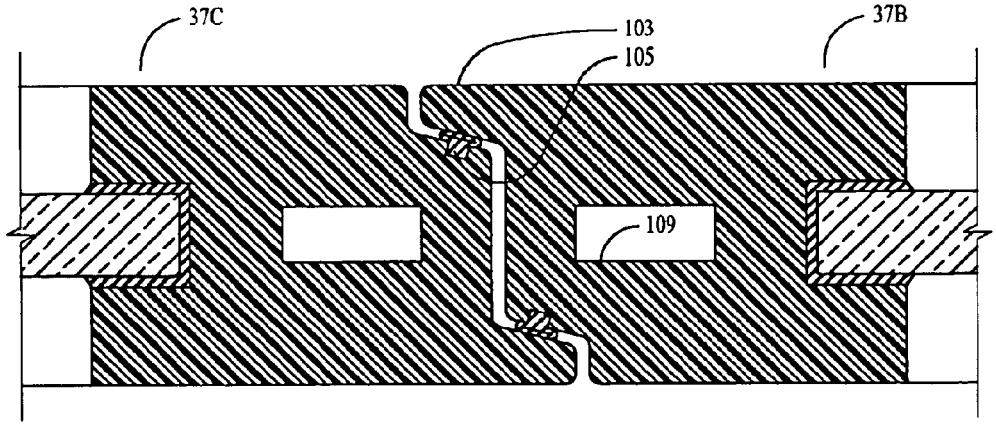
FIG. 14 is a horizontal cross sectional detail view of double door meeting stiles as shown in FIG. 3.

FIG. 14 illustrates meeting stiles 37B and 37C of double door unit 35. Each stile has a tapered protrusion 103 at one side of the edge, and at the other side there is a cavity corresponds to the protrusion 103, the two door stiles meet in an 180 degree rotated impression. Cavity 109 serves as the rated housing for locks and other hardware.

Figure 15:
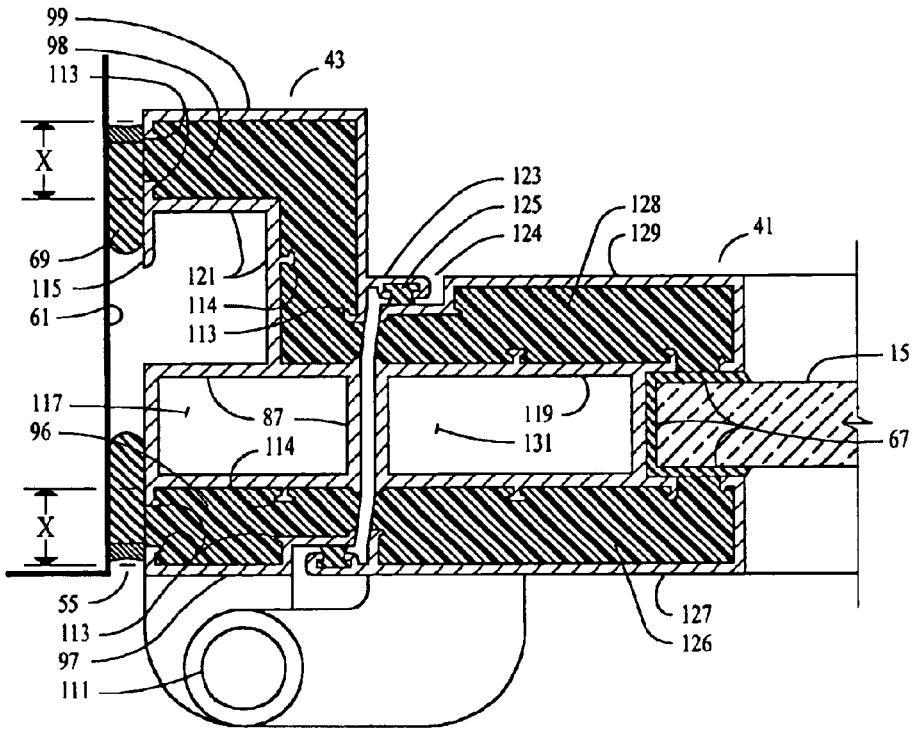
FIG. 15 is a horizontal cross sectional detail view alternative of a door frame as shown in FIG. 13.

FIG. 15 illustrates another exemplary embodiment of this invention for providing a fire resistant rated door stile 41 and jamb 43. The two components of this embodiment have a composite combination of metal shells, and a fire barrier material. An inner structural shell and an exposed shell at each side of each of the door jamb and the door stile are extruded in one piece preferably of aluminum, and connected in such a way that the connecting portions are removed to eliminate the possibility of thermal conductivity between the exposed shells and the inner structural shell. See also FIGS. 19–21 which illustrate the design and details for making such a component. Fire barriers 96 and 126 compose a continuous fire barrier at one side, and barriers 98 and 128 compose a continuous fire barrier on the opposite side of both the stile 41 and the jamb 43. The four fire barriers have a constant thickness "X". Thickness "X" is a variable dimension corresponding to the thickness of the above mentioned fire barriers necessary to resist fire for the duration time specified for different fire ratings.

Jamb 43 has a metal inner structural shell 87. The shell 87 has two barbs 113, and two "T" tee shaped barbs 114. The barbs 113 the 114 integrate with and retain the fire barriers 96 and 98. The outer exposed shell 97 has two barbs 113 which integrate with and are retained by fire barrier 96. The exposed shell 97 is parallel to the adjacent wall of the inner structural shell 87, and is at constant distance "X". The exposed shell 99 has an angular shape and is located at the other end of the jamb 43. It has two barbs 113 which integrate with and are retained by fire barrier 98. The structural shell 87 has angle portion 121 formed parallel to the exposed shell 99 at a constant distance "X" from the exposed shell. It should be appreciated that barbs 113 and 114 may be of many shapes and can be distributed in different numbers and arrangements along shell walls to perform both the integration and retaining of the element components. Extended flange 115 holds the wedged compressible filler 69 against the wall 61. Filler 69 is capped by smoke/weather seal 55. Chamber 117 houses the hinge fasteners and other hardware and may be opened to a space inside angle 121 for less complexity in the shape of the metal extrusion. The flange 123 extends from the exposed shell 99 in a perpendicular direction and engages similarly shaped cavity 114 formed in the door stile 41. The flange 123 has a chamber to install a gasket 125 which is a resting pad for the door stile 41 at the wall of chamber 114. The jamb 43 has a similar chamber 124 and a similar flange 123 projecting from door stile 41. Each of jamb 43 and door stile 41 engage with their similar profiles which are rotated 180 degrees.

The door stile 41 has an inner structural shell 119 which has two barbs 113 and two "T" tee shaped barbs 114. The barbs 113 and 114 engage and retain the fire barrier 126. The door stile 41 has an exposed shell 127 adjacent to the hinge 111 and extends to form the flange 123. The exposed shell 127 has two barbs 113 that are engaged and held by the fire barrier 126. The exposed shell 129 is opposite shell 127 and at the other side of the stile 41. The exposed shell 129 has two barbs 113 which are integrated with and held by the fire barrier 128. The exposed shell 129 extends to form a cavity 124. The central chamber 131 is a rated housing for the hinge fasteners and other hardware. The chamber 131 of door stile 41, and the chamber 117 of jamb 43 are preferable aligned for the central location of hardware, and for a single or multiple Soss hinge if they are used.

Exposed shells 97, 99, 127 and 129 are the exposed cover of the fire barriers. Fire barriers 96 and 126 are at one side, and 98 and 128 are at the other side. These four barriers and the panel 13 comprise continuous all around fire protection for the inner structural shells 87 and 119. It is expected that the exposed shells can withstand fire for a short time before failing and melting. This may be especially so if the shells are made of aluminum. When the inner structural shells are insulated and jacketed by the barrier covers fire rating tests will give an accurate fire resistance time to the total assembly.

Figure 16:
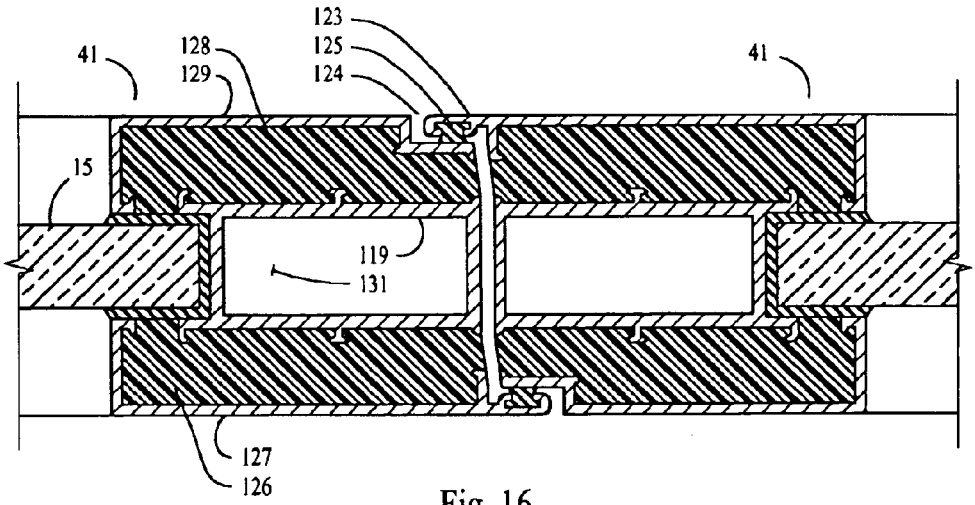
FIG. 16 is a horizontal cross sectional detail view alternative of double door meeting stiles as shown in FIG. 14.

FIG. 16 is another exemplary embodiment of meeting door stiles of this invention corresponding to the door stile 41 and jamb 43 shown in FIG. 15. Each of the meeting stiles 41 has a flange 123 at one side of the edge, and at the other side there is a corresponding cavity 124. The two door stiles meet in 180 degree rotated impression. Cavity 131 is a fire rated housing of locks and other hardware.

FIG. 17 illustrates an intermediate mullion 133. Mullion 133 has a thermally broken double shell and jacketed inner structural shell protected with fire barriers covered by exposed shells. The mullion 133 is the main component of the assembly, and it has double shells at the front and back. The double shell at the front is composed of an inner structural shell 135 and the exterior exposed shell 141 with a barrier 137 in between the two shells. The double shell at the back is composed of a shell 135 and an interior exposed shell 143 with barrier 145 in between the two shells. The two glass retainers 139 are preferably at the interior side bracket exposed shell 143 and comprise a continuous fire barrier around structural shell 135. Retainers 139 are removable and they are necessary for the field glazing method described herein. All the shells have barbs 113 to integrate with and engage the middle sandwiched fire barrier material and they may have different shapes and arrangements. Installing the glass panel 15 starts with removing the retainers 139. The inner structural shell 135 is exposed such that there is enough clearance for the edge of the glass panel 15 to fit into place. The angled lining pad 147 may be of one or two pieces and may be installed in the shop or in the field prior to installing the glass panel 15.

The next step is to move glass panel 15 in a straight outward direction "A" until the edge of the panel rests against the two sides of the angled lining pad 147. The lining pad 147 should be buttered with weather/smoke sealant 55 on all surrounding surfaces as well as glass panel 15. A glass retainer 139 may be installed and maneuvered in a clear space which may be filled later by a wedge 153. The glass retainer 139 is to be moved in direction "B" until its two hooking barbs 149 are engaged and retained by the two corresponding barbs 151. The barbs 151 extend from inner structural shell 135 to retain each of the two glass retainers 139. Glazing wedge 153 may be squeezed into place and wedged between the glass panel 15 and the glass retainer 139. A wedge 153 locks the glass retainer 139 into place. The exposed edge of the lining pad 147 and the wedge 153 may be capped with a bead of weather/smoke sealant 55 as the last step of panel installation.

Figure 18:
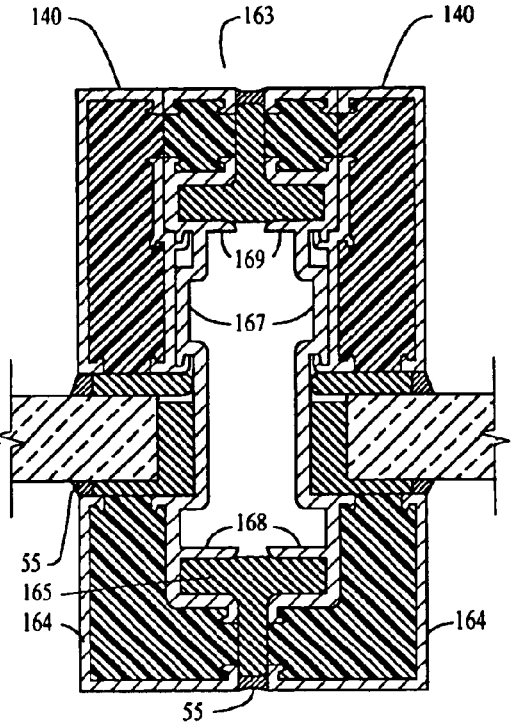

FIG. 18 illustrates an exemplary embodiment of a split mullion 163. Split mullion 163 is composed of two mirror image back-to-back female halves 164 and provides a continuous fire barrier around structural core shells 167. Each Half 164 has thermally broken double shells at the front and at the back. Halves 164 get assembled together by using "T" tee shaped mullion spacers 165 at the front and back. Flanges 168 and 169 of shells 167 form the pocket chamber where spacer 165 will engage the two halves of the mullion. Spacer 165 is preferably made of compressible mineral fibers or other fire resisting materials similar to the glazing pad 147 and the wedge 153. A weather/smoke sealant cap 55 may be applied to the joints at the front and back of the split mullion 163 with a spacer 165 as a back-up.

Figure 19:
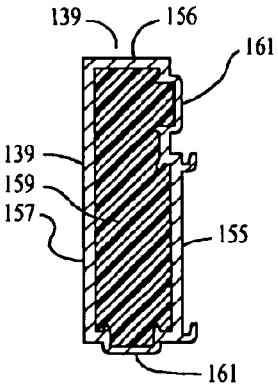
FIGS. 19–21 are horizontal cross sectional detail views of the design, and the steps to provide a double shell retainer for providing a thermal break for all double shell components and of the mullion assembly as shown in FIG. 17.
Figure 20:
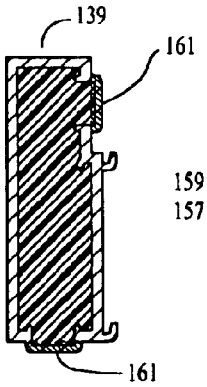
Figure 21:
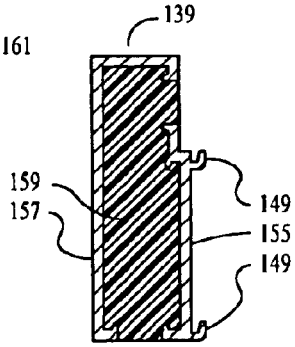

FIGS. 19–21 are horizontal cross sectional detail views of the design, and the steps to provide for providing a thermal break for all double shell components of this invention, including the assembly of mullion 133, as shown in FIG. 17. FIG. 19 shows the extruded aluminum full shape 156 of panel retainer 139, which is used as the casting form for the fire barrier material. A fire barrier 159 is cast or applied inside an extruded tubular closed shell 156. A part shell 155 and part shell 157 are connected with a bridge connector 161. Connectors 161 may have a thinner wall thickness. FIG. 20 Shows connectors 161 to be removed with cross hatching. FIG. 21 shows retainer 139 after being thermally broken by removing the connector 161. The barrier 159 connects the two shells 155 and 157. It should be appreciated that an alternative way of providing a thermally broken double shell member may be to provide the two shells preferably in metal pre-shaped, bent or extruded and the thermal break barrier material also pre-shaped. In this way various means of assembling, fastening or snap-fitting the components together may be utilized.

Figure 22:
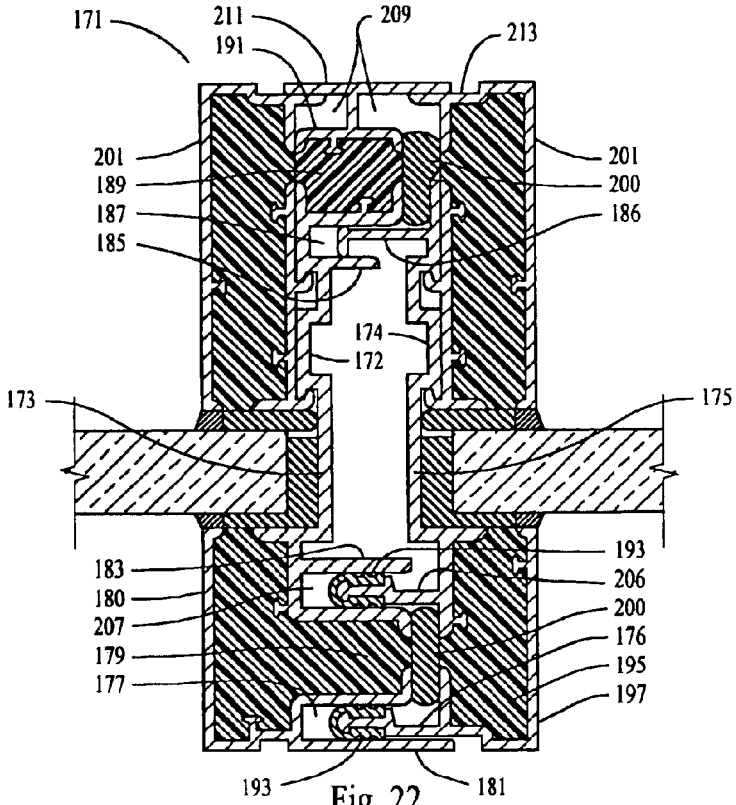

FIG. 22 illustrates an alternative split mullion 171. Mullion 171 has a weather/smoke seal created by two gaskets 193. The gaskets 193 are located at the front end of the mullion and are housed inside cavities 177 and 207. A flange 181 in combination with flange 176 and cavity 177 at the front end of mullion provide added fire resistance to the jointed portion of front end of the mullion 171. A flange 211 in combination with flanges 213 and the adjacent two cavities 209 provide added fire resistance to the jointed portion of the back end of mullion 171. The mullion 171 is composed of two thermally broken double shell halves, female half 173 and male half 175. The front of female half 173 has two cavities 177 and 207 separated by a fire barrier 179. The flange 181 partially forms the front central portion of mullion 171 and extends from exposed shell 180 of female half 173 and forms one side wall of cavity 177.

The flange 183 extends from structural shell 172 of the female half 173 and it forms one side wall of cavity 207. A flange 185 extends from an inner female structural shell 172 and forms the side wall of cavity 187 at the back of mullion 171. Inner female structural shell 172 of female half 173 has a barrier 179 at its front portion. The exposed shell 180 is retained by the barrier 179. Inner female structural shell 172 also retains the barrier 189 at the back of mullion 171, which in turn retains an interior exposed shell 191. Male half 175 retains barrier 195, and barrier 195 retains exposed shell 197 at the front of mullion. The male half 175 has a flange 186 that extends from the structural shell 174 at the back of mullion 171. The flange 186 is formed as a "T" tee shape for technical extruding precautions. A flange 206 extends from the structural shell 174, and the other flange 176 extends from exposed shell 197. Flanges 176 and 206 align with cavities 177 and 207 respectively. The two gaskets 193 may be pre-installed at the end of flanges 176 and 206. Gaskets 193 are made of heat resistant compressible silicone or mineral fiber or the like of single or multiple heat resistant materials.

One half of the split mullion is preferably installed first, after which the other half interlocks with and is retained by the first half, where the flange 186 and the two gasket covered flanges 176 and 206 engage the cavity 187 and the two cavities 177 and 207 respectively. Two gaskets 193 provide double seal for weather/smoke between the two sides of the curtain wall, where gasket 193 and cavity 207 are protected by the fire barrier 179, and are included with the thermally broken inner structural shells 172 and 174. Compressible filler and fire barrier 200 is back adhered to the female half 173 to fill the variable width of the joint between the two halves of mullion 171. These provide a continuation to the fire barrier around the inner structural core shells 172 and 174. The glazing retainers 201 and the installation steps of the glass panel are explained in FIGS. 23–25.

Figure 23:
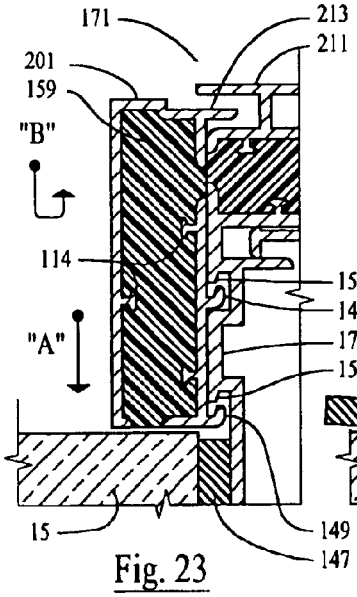
FIGS. 23–25 are horizontal cross sectional detail views of the installation steps of the retainer for installing the facing panel or glass as shown in FIG. 22.
Figure 24:
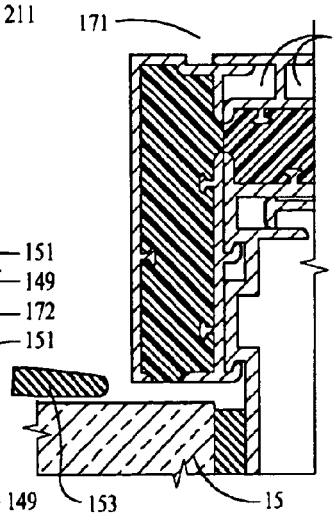
Figure 25:
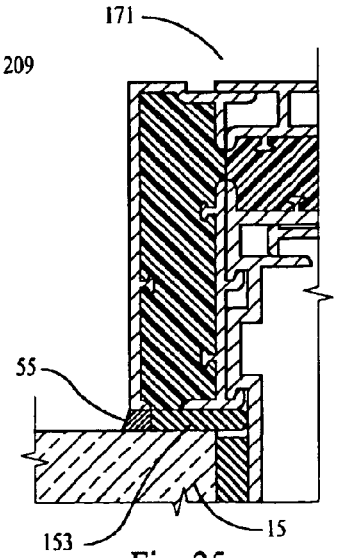

FIGS. 23–25 illustrate the installation of retainer 201 to secure the glass panel 15 to mullion 171. Retainer 201 is composed of a thermally broken double shell similar to the retainer 139 shown in FIG. 17. The two shells of retainer 201 have barbs 114 to integrate with and engage the middle sandwiched fire barrier material 159. Barbs 114 may have different shapes, locations and arrangements. Installing the facing panel 13 preferably glass panel 15, starts with removing the retainer 201 from inner structural shell of mullion 171 to allow enough clearance for the installation of the edge of glass panel 15. An angled lining pad 147 is installed inside a glazing chamber before installing the glass panel 15.

Next the glass panel 15 is moved in a straight outward direction "A" until the edge of panel rests against the two sides of the angled lining pad 147. The angled lining pad 147 should be buttered with weather/smoke sealant 55 on all surrounding surfaces, as well as glass panel 15. The glass retainer 201 is put in place and maneuvered in the clear space which will be filled later by a wedge 153, as shown in FIG. 23. The retainer 201 is to be moved in direction "B" such that it travels inward towards the back of mullion until its two hooking barbs 149 are engaged and retained by the two corresponding barbs 151. This movement in the direction "B" allows flange 213 to rest against the back side of flange 211 and closes the cavities 209 where the joint between the two halves are located, as shown in FIG. 22. Barbs 151 extend from inner structural shell 172. Glazing wedge 153 is wedged in-place between glass panel 15 and retainer 201. The wedge 153 locks the retainer 201 in its place. Finally, the exposed edge of lining pad 147 and the wedge 153 are capped with a bead of weather/smoke sealant 55.

Figure 26:
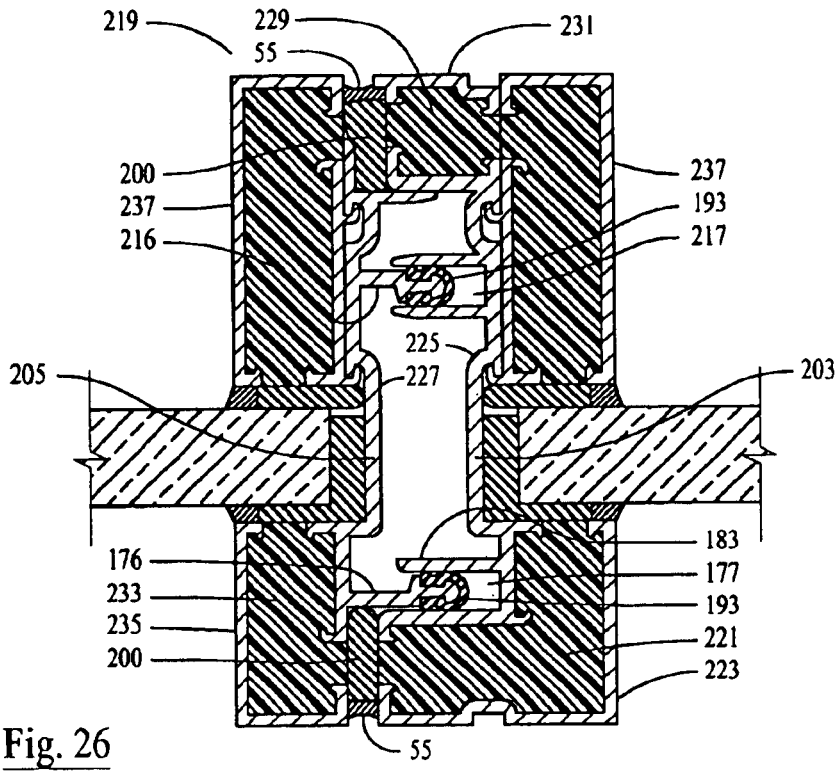

FIG. 26 illustrates another exemplary embodiment of a split mullion of this invention. A mullion 219 is composed of female mullion half 203, and male mullion half 205. Structural shells 225 and 227 are the major components of the female half 203 and male half 205 of mullion 219 respectively. Mullion 219 has two weather/smoke seals provided by gaskets 193, one located at the front end of mullion 219, and the other at the back end of mullion 219. Seal gaskets 193 are housed inside cavities 177 and 217. The two weather/smoke seal gaskets 193 and their attaching flanges 176 and 216, cavities 177 and 217 are integral parts of the inner structural shells 225 and 227 of the mullion 219. A fire barrier 221 is integrally attached to exposed shell 223 and secures exposed shell 223 to structural shell 225 at the front of female half 203. A barrier 229 secures the exposed shell 231 to the structural shell 225 at the back of mullion 219. A barrier 233 secures exposed shell 235 to structural shell 227 of male half 205. Retainers 237 are similar to retainers 139 and 201 of the previous figures and glass panels 15 are installed in the same manner described previously. Compressible fillers and fire barrier 200 is back adhered to one side and capped with a bead of weather/smoke sealant 55. Filler 200 fills the variable width of the joint between the two halves of mullion 219 and provides a continuous fire barrier around the inner structural core shells 225 and 227 of the mullion 219.

Figure 27:
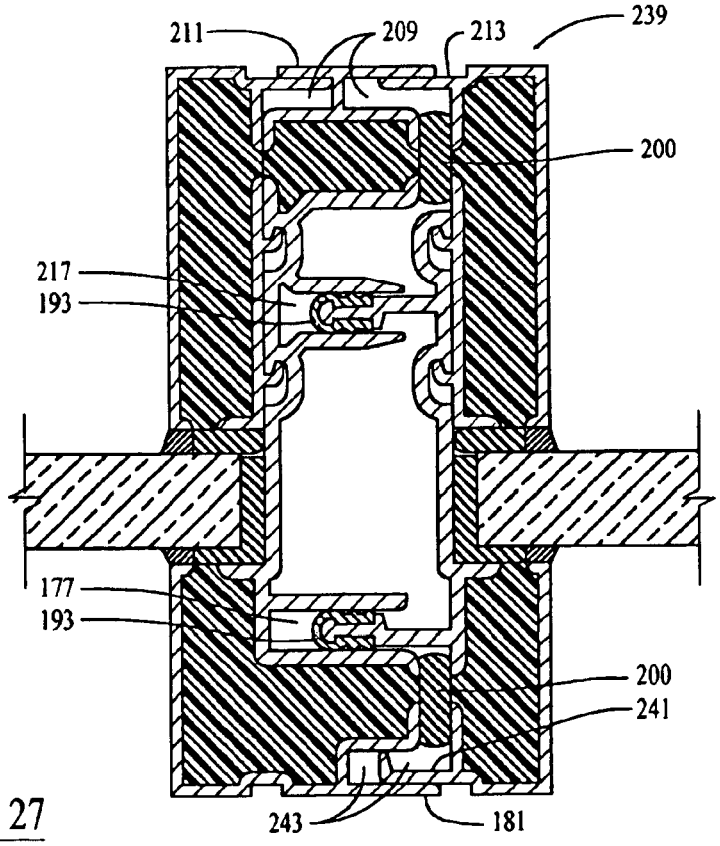

FIG. 27 illustrates an exemplary embodiment of a mullion of this invention. Mullion 239 is similar to mullion 171, as shown in FIG. 22. A flange 181 in combination with flange 241 and cavities 243 at the front end of mullion 239 provide added fire resistance as a cover for the jointed portion at the front of mullion 239. The flange 211 in combination with flanges 213 and the adjacent two cavities 209 at the back end of mullion provide added fire resistance for the jointed portion at the back end of the mullion 239.

Figure 28:
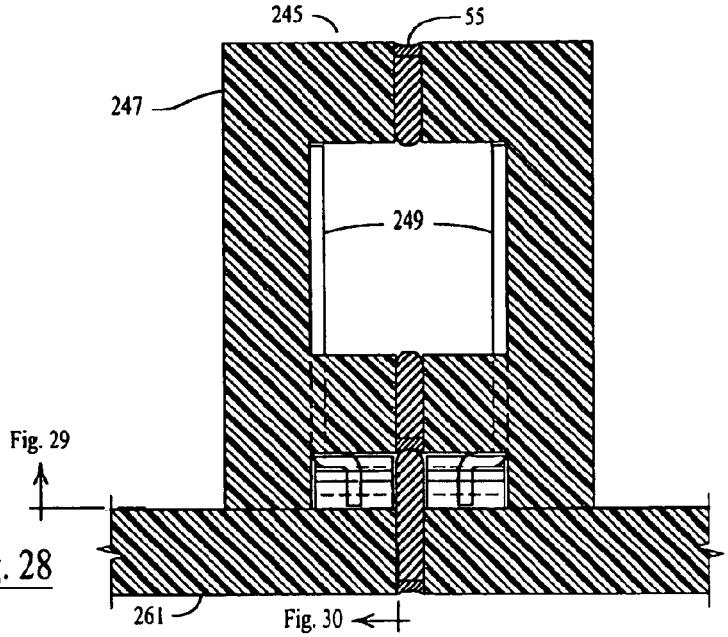
Figure 29:
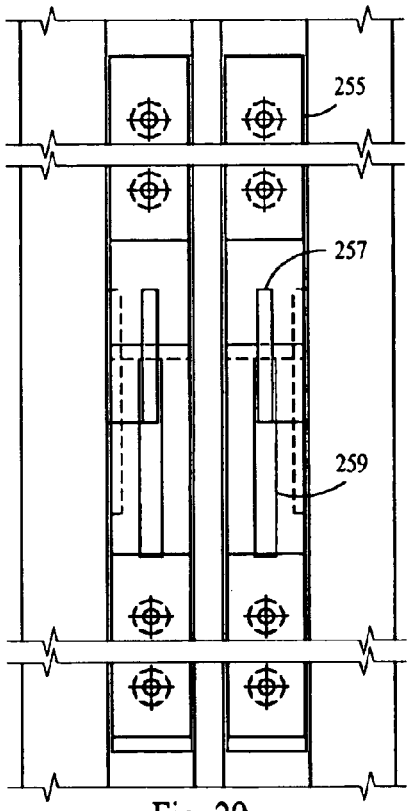
FIGS. 29 and 30 illustrate vertical front and side views for an attachment method of a panel to a mullion, shown in FIG. 28.
Figure 30:
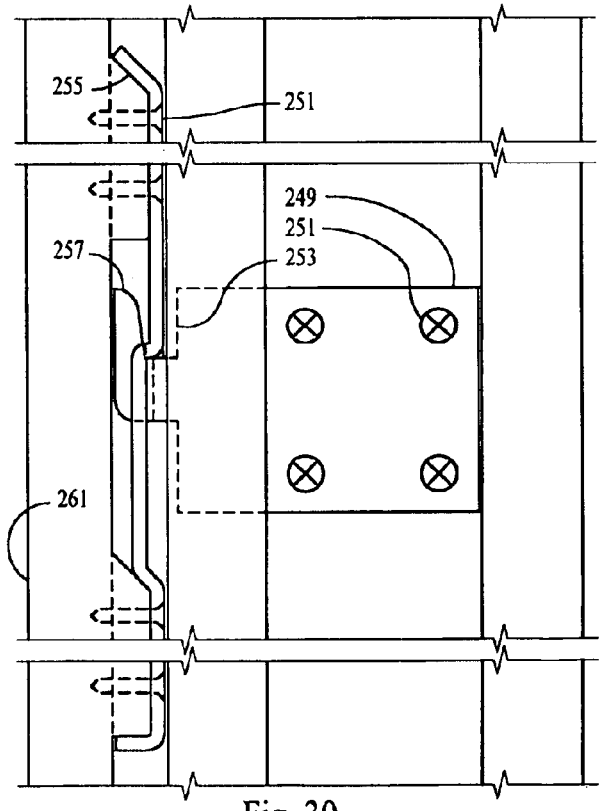

FIGS. 28–30 illustrate another exemplary embodiment of a mullion according to this invention. Mullion 245 may have an inner structural shell and an exposed shell, and it may be a one piece mullion or a two half split mullion shaped and detailed similar to other mullions presented herein. Mullion 245 is composed of a fire barrier 247 and has one or multiple cavities, where each cavity may either be continuous or carved for attaching the a panel fastener 249. Panel fastener 249 may be a "Z" shaped plate anchor attached with concealed screws 251. The front portion is shaped with a pocket 253 at the top such that a nib 257 is pointing up to receive and retaining anchor 255. The retaining anchor 255 may be attached to the back of facing panel 13 or glass 261. The retaining anchor 255 may be a single or multiple anchors, and may also act as an integral part of the panel, or it may be pre-attached with screws 251 or other anchoring means. Retaining anchor 255 has a slotted hole 259 and it is engaged and retained by nib 257. The panel 261 is installed by moving it to rest on the front face of the mullion 245 while aligning slotted hole 259 with nib 257 and urging the panel that nib 257 engages through slotted hole 257, allowing the panel 261 to drop down and be hooked by nib 257.

Figure 31:
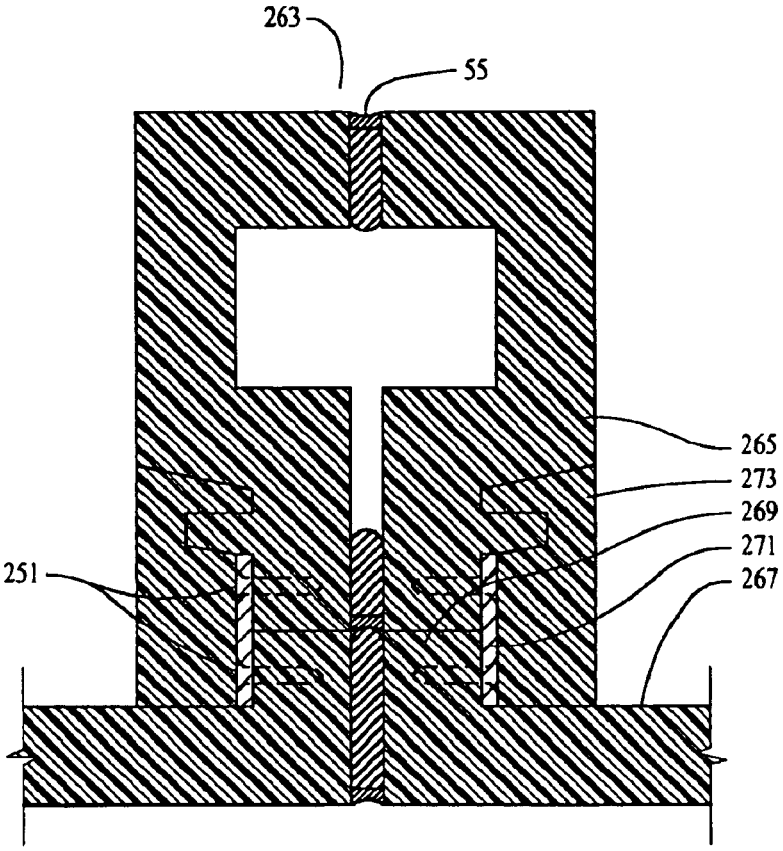

FIG. 31 illustrates another exemplary embodiment of a split mullion according to this invention. A Facing panel 267 has an angled integral return 269. The return 269 may be single or multiple pieces, and the facing panel 267 may be attached by fastening a minimum of one anchor plate 271 to the mullion 263 and to the integral return 269 of the facing panel 267. Cover 273 may be installed to mullion 263 to conceal the anchor plate 271 and screws 251.

Figure 32:
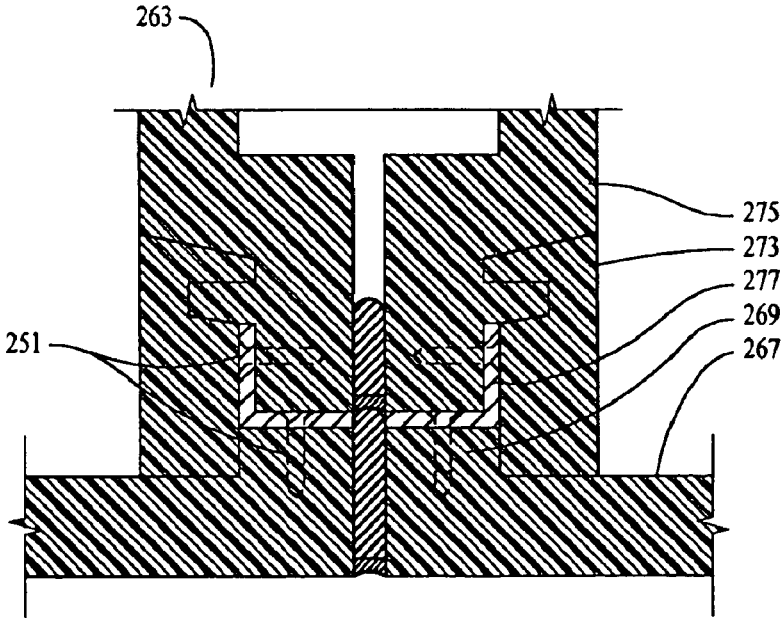

FIG. 32 illustrates a mullion 275 similar to mullion 263, as shown in FIG. 31. Anchor angle 277 may be pre-attached to the back of a facing panel 267. If the facing panel 267 is too thin to accommodate screws or the like, it may have an integral return 269. Angle 277 may also be fastened, or attached to, or integrally formed as part of the facing panel 267 and it may also be directly attached to the back of facing panel 267.

Figure 33:
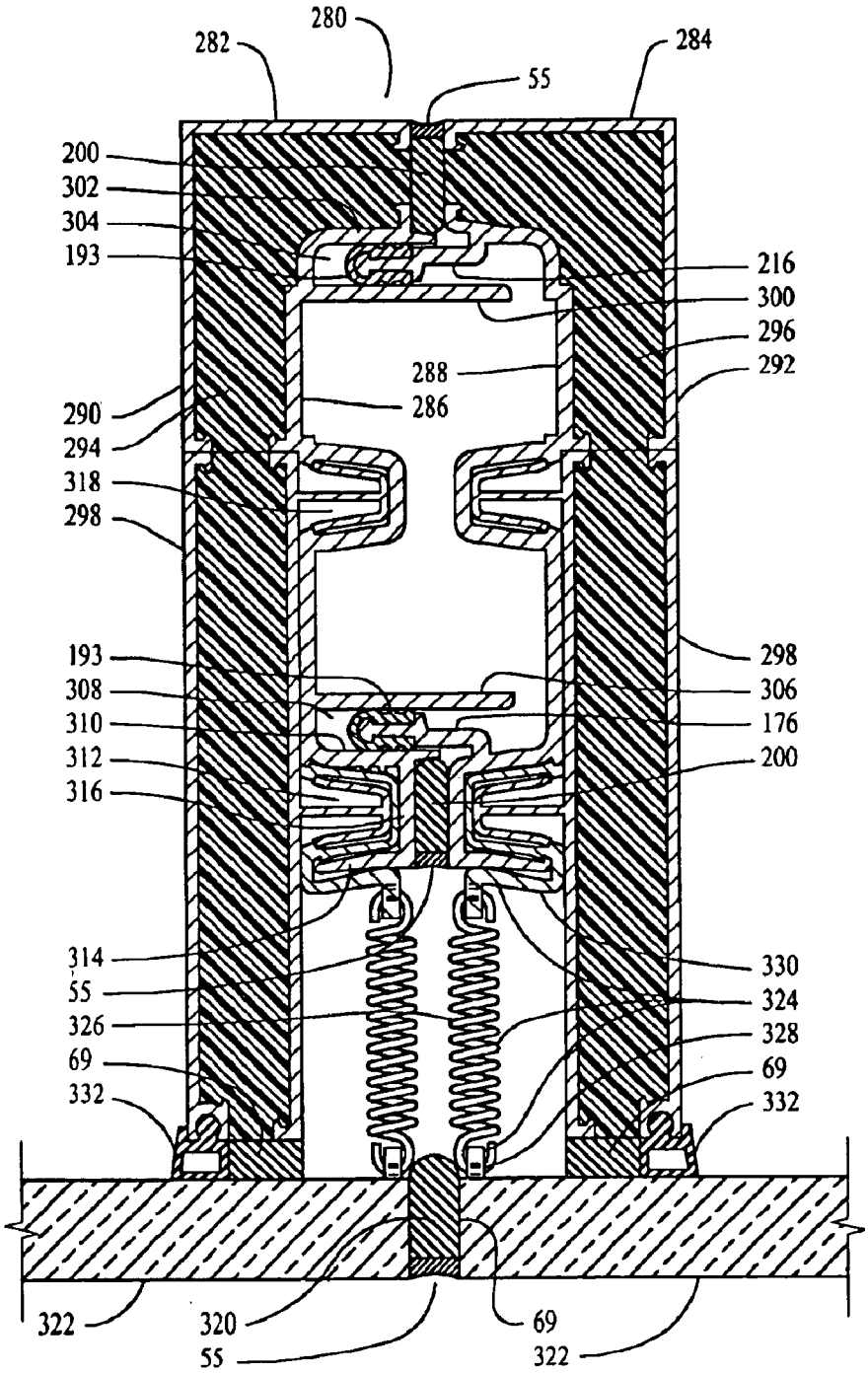
FIG. 33 is a horizontal cross sectional detail view of a mullion alternative comprising a fire resistant rated/Seismic safe stopless glazing curtain wall/fenestration system that can withstand earthquake forces.

FIG. 33 is an exemplary embodiment of a fire resistant rated/seismic safe stopless glazing curtain wall and fenestration system. Female half 282 and male half 284 compose split mullion 280. Female half 282 and male half 284 respectively are composed of inner structural shells 286 and 288, angle shaped outer exposed shells 290 and 292, and barriers 294 and 296. The barriers 294 and 296 are integrally attached to, and secured by the two adjacent shells and each barrier protects the attached inner structural shell. The two shells of each female half 282 and male half 284 may be extruded as one shell, to be used as the casting form. They may then be filled with fire barrier, separated and thermally broken in a similar way as described in FIGS. 19–21. Female shell 286 has a flange 300 at the back portion, parallel to the adjacent back wall 302 where a cavity 304 is formed between the flange 300 and the back wall 302. It should be appreciated that a one piece intermediate mullion and an end mullion may be developed by making few simple changes to the split mullion 280 of this embodiment.

Female shell 286 has a flange 306 parallel to an adjacent web 310 at the front portion of mullion 280 and a cavity 308 is formed between the flange 306 and the web 310. The inner structural shell 288 of male half 284 has two flanges 176 and 216. These two flanges have weather/smoke gasket seals 193 attached at their tips. Flanges 176 and 216 are aligned with and engage chambers 308 and 304 respectively during installation. Channel chamber 312 is at the front end of structural shells 286 and 288. Channel chamber 318 is similar to chamber 312 and formed by the side wall of structural shell of each mullion half. A fire resistant compressible filler 200 is at the front and back joint of the two mullion halves 282 and 284. Each filler 200 is capped with a weather/smoke sealant 55, which also seals the joint between the two mullion halves 282 and 284 at both ends.

Joint 320 is between the two adjacent facing panels preferably of glass 322. A compressible joint filler 69 is applied to joint 320 and panels 322 and is sealed with weather/smoke sealant 55 after installing the two panels 322 in place. An elastic panel fastener 324 is an integral part of panel 322. The elastic panel fastener 324 comprises at least one spring 326 and at least one end element 330. The spring 326 is attached at the inner side to end element 330. It should be appreciated that the spring 326 and the end element 330 may be manufactured as a single piece elastic holding element. The spring 326 is shown with its ends shaped in a conventional hook shape for simplicity, but it may be provided with any other shape that facilitates attachment to either the back or the edge of the panel 322. The spring may also be attached either directly to the facing panel 322, or to a barb 328, as shown.

Structural engineers use few guidelines to assume the maximum wind pressure that the a building may be subjected to, and wind pressure may result in compression (positive wind pressure) at one side of the building, while at the same time the facade at the opposite side of the building may be subjected to suction wind pressure (negative wind pressure). As such, the same part of the facade of a building may be repeatedly subjected to compression or suction wind pressure.

According to this embodiment, a spring 326 having sufficient strength to withstand the maximum assumed negative wind pressure with minor elongation in the outward suction direction is provided within the mullion 280. The spring 326 is also capable of elongating when the edges of panels 322 are under the extreme forces caused by an earthquake. The spring 326 is not considered for withstanding compression forces during the positive wind pressure. However, compression forces will be resisted by holding element 298. The gasket seal 332 is pre-installed to holding element 298 and fire resistant compressible filler 69 is back adhered to holding element 298. The gasket 332 and the adjacent compressible filler 69 act as a cushion between the mullion 280 and panels 322. Holding element 298 is snapped in and interlocked with mullion 280, as well as with the elastic panel fastener 324.

Figure 34:
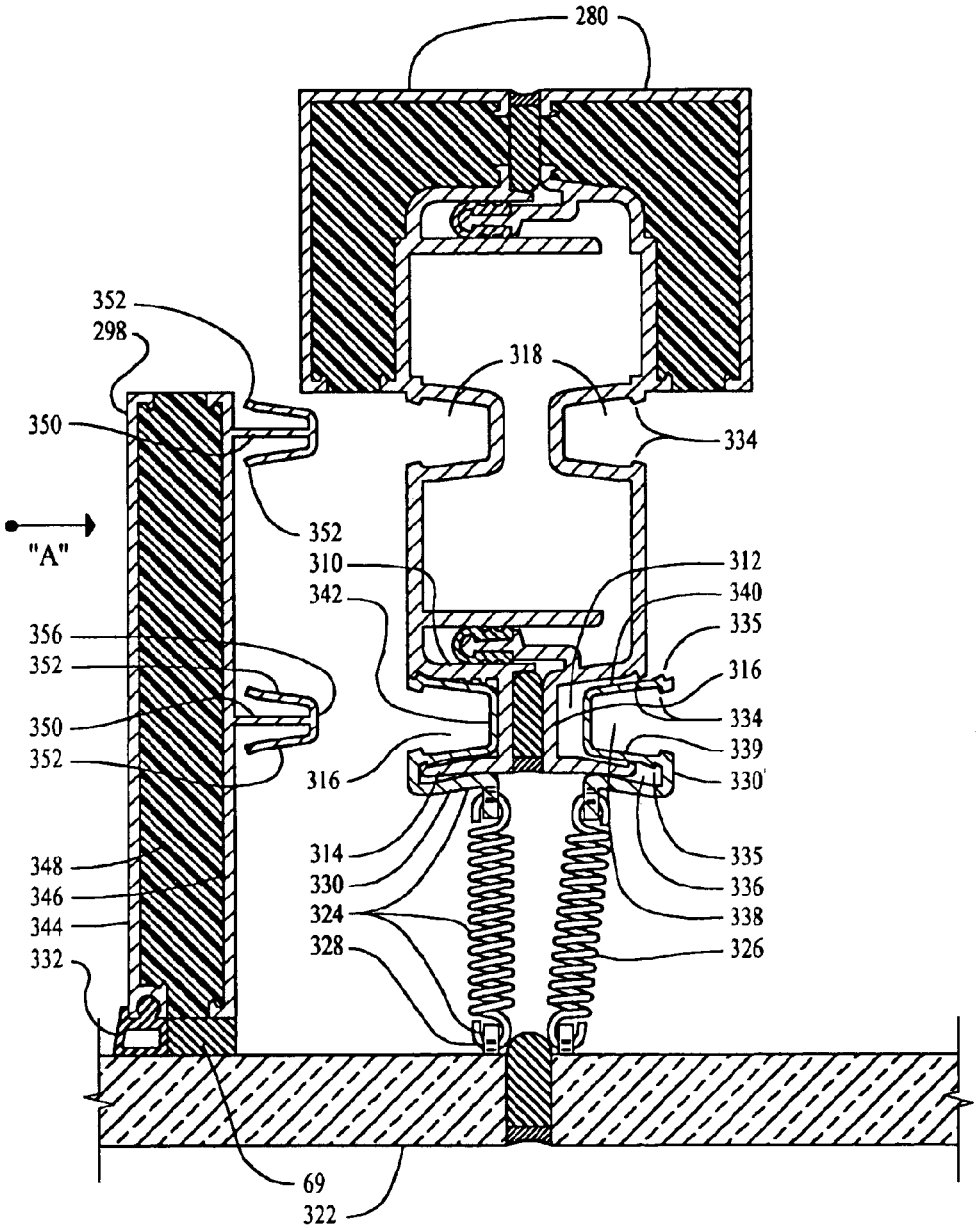
FIG. 34 is a horizontal cross sectional detail view of the installation steps for retaining the facing panel or glass, and holding element, for a mullion shown in FIG. 33.

FIG. 34 is a horizontal cross sectional detail view of the installation steps for assembling the mullion 280 of FIG. 33 and installing panels 322. The panels 322 are preferably made of glass, or other transparent materials. As illustrated, the facing panels 322 are integrally attached to the elastic panel fastener 324 of panel 322. The holding element 298 is then snapped in and interlocked with the mullion 280 and also with the elastic panel fastener 324. The mullion 280 is also connected via the elastic panel fasteners 324 to panel 322. A channel shaped chamber 312 is at the front end of the structural shells, and formed with three walls, the front wall 314 of mullion 280, the parallel web wall 310, and wall 316. The wall 316 connects the two walls 314 and 310 and extends parallel to mullion side walls. The channel chamber 318 is similar to chamber 312 and the three side walls of the channel are formed by the side walls of the structural shell of each mullion half. Interlocking barbs 334 are formed at the outer end of the two side walls of each channel shaped chamber 312 and 318. The spring 326 is attached to end elements 330. The end elements 330 have an "S" shape with two compartments, one small compartment 336, and a larger channel shaped compartment 338. Compartment 336 has a "Z" shaped element with one end attached to flange 340 of channel element 339. The "S" shaped end element 330 has a compartment 338 formed by channel element 339. Channel element 339 has two flanges 340 connected with web 342. Channel compartment 338 is similar to both of the other chambers 312 and 318 of the mullion halves, and also has two interlocking barbs 334 at the outer end of the two flanges 339 and 340 similar to channels 312 and 318 at the inside of channel compartment 338. Two interlocking barbs 335 are formed at the ends of the two flanges 339 and 340 at the outer side of channel element 339. The two interlocking barbs 335 correspond to the two barbs 334 of chamber 312.

The two mullion halves are illustrated fully installed and the left side facing panel 322 is secured and snap locked to the mullion 280. The installation steps of the right side facing panel 322 begin by inserting the channel element 339 of "S" shaped end element 330 inside chamber 312, as shown at the right side of mullion 280 and urging it all the way inside until the two barbs 335 interlock with the two corresponding barbs 334 of chamber 312, as shown installed at the left side of mullion. The holding element 298 has an outer exposed shell 344 and an inner structural shell 346, and the two shells are integrally attached with a barrier 348 in between the two shells. Two "E" shaped anchoring elements 350, each with two side flanges 352 and web 356 are connected to the three flanges of anchoring element 350. The anchoring element 350 is attached to the structural shell 346 at one end, and at the other end to attaching web 356.

Interlocking barbs are formed at the free end of each side flange 352 corresponding to interlocking barbs of chamber 318. These barbs also correspond to the interlocking barbs located inside channel compartment 338 of the end element 330. End element 330 is shown already installed inside chamber 312. The two anchoring elements 350 are aligned with chamber 318 at the mullion side walls, and with channel compartment 338 of end element 330. The last installation step is installing holding elements 298 to the two sides of mullion 280, by engaging the two anchoring elements 350 of the holding element. Anchoring element 350, located on the upper portion of structural shell 346, engages chamber 318 and the lower anchoring element engages compartment 338. The anchoring elements 350 are urged inside the corresponding chambers, as shown by direction "A" until the corresponding barbs interlock.

Figure 35:
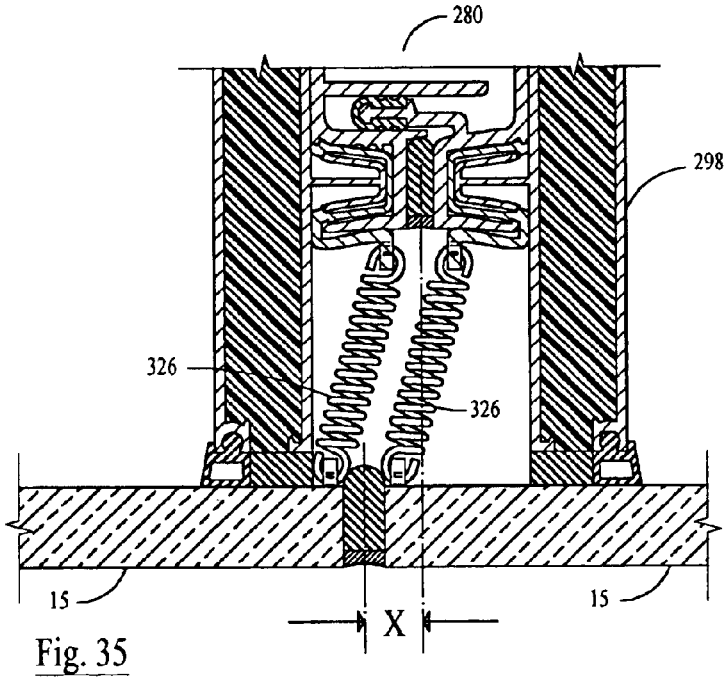
FIG. 35 is a horizontal cross sectional detail view of the front portion of mullion illustrated in FIG. 33 where a building facade is subjected to lateral movements.

FIG. 35 illustrates the advantageous manner in which the exemplary embodiment of this invention as described in FIG. 33 copes with the expected effects of earthquakes. When the building sways in a plane parallel to the glass panels 15, the angularity of the frame members may change. However the glass panels 15 will not deform. The swaying of the building may cause the mullion 280 to travel sideways with a distance "X" from the centerline of panel joint, and the travel distance "X" can be tolerated by the springs 326.

Figure 36:
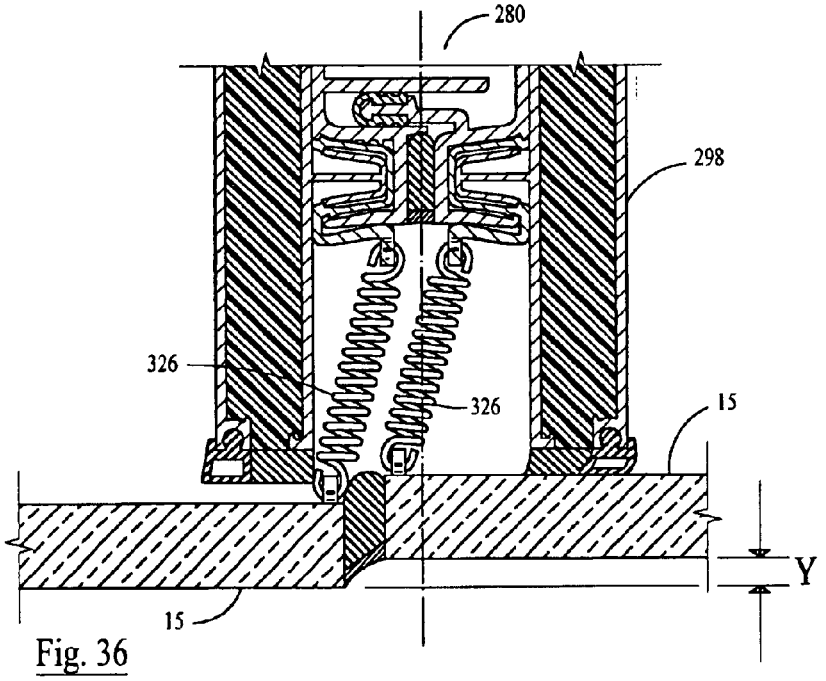
FIG. 36 is a horizontal cross sectional detail view of the front portion of a mullion illustrated in FIG. 33 where the building facade is subjected to lateral movement while the building facade is also subjected to twisting movement.

FIG. 36 illustrates the condition of compounded deformity of the frame members. Buildings may be designed such that the elevators, service core and wind bracing diaphragm are not centrally located, or the building may not be symmetrical in height, shape or foot print. In addition the building center of gravity may not coincide with the planes of the movement resisting diaphragm, in this case the motion caused by an earthquake may cause a twisting action on the building. This in turn may cause the frame at two diagonal corners of the building to push out the glass panels 15. Because of the rigidity of the glass panels 15 the two other diagonal corners may also be pulling out at the opposite corners of the frame. This results in a corner of the facing panel have the tendency to pull outward, while the corners of the adjacent panel have the tendency to push inward. The springs 326 will still tolerate this movement of the "Y" distance. Stopless glazing is the best suited system to allow mullions and glass panels 15 to move as illustrated without damage.

While this invention has been described in conjunction with specific embodiments outlined above, it is evident that many alternatives, modifications and variations will be apparent to those skilled in the art. Accordingly, the preferred embodiments of the invention, as set forth above, are intended to be illustrative, not limited. Various changes may be made without departing from the spirit and scope of the invention.

What is claimed is:

1. A fire resistant fenestration system for preventing the spread of fire in a structure, comprising:

a fire resistant panel; and at least one mullion having a channel to accommodate and hold the panel, the at least one mullion includes an inner structural shell, an outer shell, and a barrier formed of a fire resistance material wherein the barrier is disposed between the inner structural shell and the outer shell, and wherein the inner structural shell, the outer shell, and the barrier of the mullion are on both sides of the panel; and at least one retainer for installing and removing the panel, the at least one retainer includes at least one hooking barb, wherein the at least one hooking barb engages with at least one corresponding barb on the inner structural shell.

2. The fire resistant fenestration system according to claim 1, further comprising at least one fire resistant lining pad disposed around an end of the fire resistant panel and between the fire resistant panel and the at least one mullion.

3. The fire resistant fenestration system according to claim 1, wherein the at least one muilion has at least two channels for accommodating a plurality of panels.

4. The fire resistant fenestration system according to claim 3, wherein the at least one mullion has the at least two channels on opposite sides of the at least one mullion for accommodating two panels end to end to comprise a curtain wall.

5. The fire resistant fenestration system according to claim 1, wherein the fire resistant panel is a fire resistant glass panel.

6. The fire resistant fenestration system according to claim 1, wherein the retainer includes two hooking barbs.

7. The fire resistant fenestration system according to claim 1, further comprising an angled lining pad within the channel so that the panel rests on the lining pad.

8. The fire resistant fenestration system according to claim 7, wherein the angled lining pad includes two sides.

9. The fire resistant fenestration system according to claim 1, further comprising a wedge to be placed after the at least one retainer is installed.

10. The fire resistant fenestration system according to claim 1, further comprising at least one heat resistant weather seal disposed between the at least one mullion and the panel.

11. The fire resistant fenestration system according to claim 1, wherein the at least one mullion has at least one channel for accommodating the panel.

12. The fire resistant fenestration system according to claim 1, wherein the at least one fire resistant panel abuts at a front of the at least one mullion.

13. The fire resistant fenestration system according to claim 1, wherein the at least one mullion is a split mullion including two engaged halves and a differential thermal expansion joint is located between the two halves and located across a depth of the mullion.

14. The fire resistant fenestration system according to claim 13, where one half of the mullion is applied as an end jamb adjacent to a wall.

* * * * *